US005139171A

United States Patent [19]

Mäder

[11] Patent Number: 5,139,171

[45] Date of Patent: Aug. 18, 1992

[54] EJECTOR PISTOL FOR DOUBLE-WALLED CARTRIDGES

[75] Inventor: August Mäder, Pfäffikon, Switzerland

[73] Assignee: Maderag AG, Pfaffikon, Switzerland

[21] Appl. No.: 638,290

[22] Filed: Jan. 4, 1991

[30] Foreign Application Priority Data

Jan. 5, 1990 [DE] Fed. Rep. of Germany ..... 4000205

[51] Int. Cl.[5] ..... B67D 5/52

[52] U.S. Cl. ..... 222/137; 222/145; 222/326; 222/386

[58] Field of Search ..... 222/135-137, 222/145, 386, 319, 326, 327

[56] References Cited

U.S. PATENT DOCUMENTS

| | | | |
|---|---|---|---|
| 2,705,463 | 4/1955 | Moore | 222/137 X |
| 2,826,339 | 3/1958 | Maillard | 222/137 |
| 3,166,221 | 1/1965 | Nielsen | 222/137 |
| 4,366,919 | 1/1983 | Anderson | 222/137 |

FOREIGN PATENT DOCUMENTS

| | | | |
|---|---|---|---|
| 8714165.5 | 1/0988 | Fed. Rep. of Germany . | |
| 10913 | 9/1956 | Fed. Rep. of Germany | 222/137 |
| 3835093 | 4/1990 | Fed. Rep. of Germany . | |
| 2501080 | 9/1982 | France | 222/137 |

*Primary Examiner*—Kevin P. Shaver
*Attorney, Agent, or Firm*—Sprung Horn Kramer & Woods

[57] ABSTRACT

An ejection pistol for double-walled cartridges comprises a hand-operated pistol grip, a trough-shaped half shell, a piston rod mounted displaceably therein, and a substantially circular ejection plate disposed at the front end of the piston rod. A cylindrical tube open on one side contains two cylindrical rams disposed coaxially with each other and with the longitudinal axis of the tube.

2 Claims, 2 Drawing Sheets

EJECTOR PISTOL FOR DOUBLE-WALLED CARTRIDGES

BACKGROUND OF THE INVENTION

The present invention relates to an ejection pistol for double-walled cartridges. More particularly, the invention relates to an ejection pistol of the type comprising a hand-operated pistol grip, a trough-shaped half shell, a piston rod mounted displaceably therein, a substantially circular ejection plate disposed at the front end of the piston rod, and a cylindrical tube open on one side, mounted detachably and displaceably in the trough-shaped half shell and having affixed therein two spaced apart rams.

An ejection pistol of this type is disclosed in the German utility model Pat. No. G 87 14 165.5 and the published German patent application No. DE 38 35 093, the disclosures of which are incorporated herein by reference. Such an ejection pistol, having a cylindrical tube open on one side, offers the considerable advantage that the tube is continuously pushed by the ejection plate of the ejection pistol over the double-walled cartridge, whereby the somewhat rearwardly offset ends of the rams act upon the piston heads of the two chambers. In accordance with the advance of the cylindrical tube, the two pistons move toward the ejection opening, whereby no outward expansion can occur at the places of greatest stress on the walls of the double-walled cartridge since this is reliably prevented by the cylindrical tube surrounding the double-walled cartridge.

In the cylindrical tube described in the above-referenced patent application, the two rams have the shape of a cylindrical jacket portion and are affixed to the tube bottom coaxially with the tube. The double-walled cartridge surrounded by this tube is divided by a wall into two semicircular chambers each containing a pasty mass. To act upon the two semicircular pistons in the two semicircular chambers, the rams are spaced apart in such a way that the dividing wall of the double-walled cartridge engages the gap formed between them.

SUMMARY OF THE INVENTION

A principal object of the present invention is to provide an ejection pistol of the type described above which can evenly eject double-walled cartridges that are not divided into two semicircular chambers by a wall extending in the center, but are divided by a tube coaxial with the longitudinal axis into a inner cylindrical space and an outer, ring-shaped space which contain the two pasty masses separately.

This object, as well as other objects which will become apparent in the discussion that follows, are achieved, in accordance with the present invention, by configuring the rams in a cylindrical shape and by affixing the rams to the tube bottom coaxially with each other and coaxially with the longitudinal axis of the tube.

The longitudinal extent of the two rams of different diameter is advantageously made smaller than the longitudinal extent of the cylindrical tube.

The present invention will now be explained in more detail with reference to the drawing showing an advantageous exemplary embodiment.

DESCRIPTION OF THE PREFERRED EMBODIMENT

Figure 1:
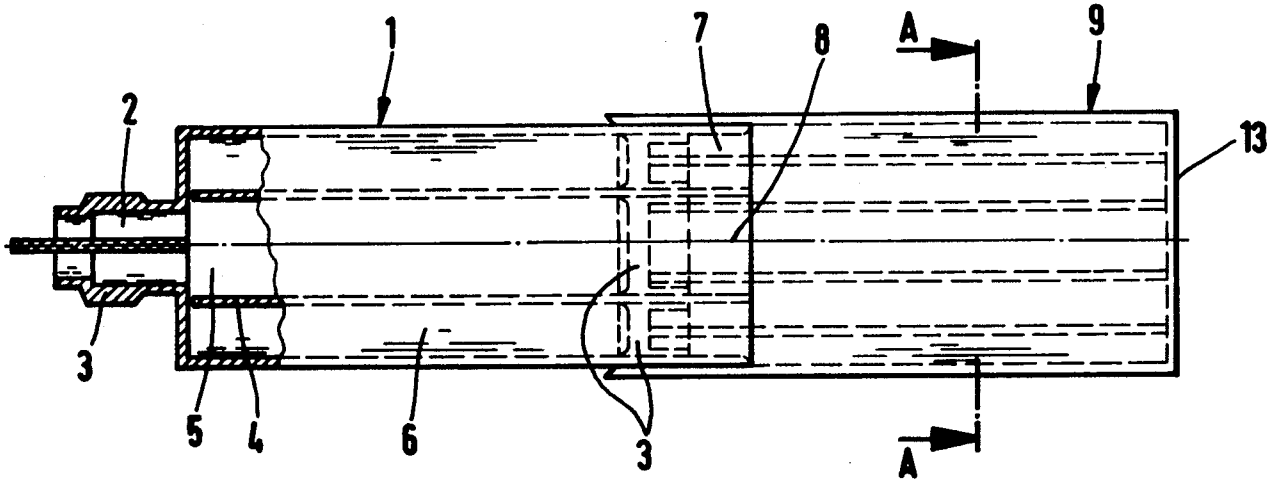
FIG. 1 shows a section through a double-walled cartridge and a corresponding cylindrical tube according to the invention.

FIG. 1 shows a longitudinal section through a double-walled cartridge 1 which is provided with an outlet port 2 and a possibly screw-on type mixing tip 3. In the longitudinal direction the double-walled cartridge 1 is divided by a cylindrical wall 4 into two chambers 5, 6 each containing a pasty mass. Cylindrical wall 4 divides an inside cylindrical chamber 5 from an outer ring-shaped chamber 6 surrounding it. Cylindrical chamber 5 is closed by a cylindrical piston 8, and ring-shaped chamber 6 by a ring-shaped piston 7. Pistons 7, 8 are displaced toward the outlet port.

For simultaneous, precise ejection of the two pasty masses in chambers 5,6, a cylindrical tube 9 is inserted into a conventional ejection pistol of the type comprising a hand-operated pistol grip, a trough-shaped half shell, a piston rod mounted displaceably therein and a substantially circular ejection plate disposed at the front end of the piston rod. Such an ejection pistol is shown in FIG. 3. The cylindrical tube 9 is open on one side and has affixed therein two circular rams 10, 11 disposed coaxially with each other and with longitudinal axis 12 of the cartridge 1. The cylindrical tube 9 is closed at its end 13 associated with the ejection plate of the ejection pistol, this bottom having affixed thereto the two cylindrical rams 10, 11 (FIG. 2) whose longitudinal extent is smaller than that of cylindrical tube 9.

Figure 2:
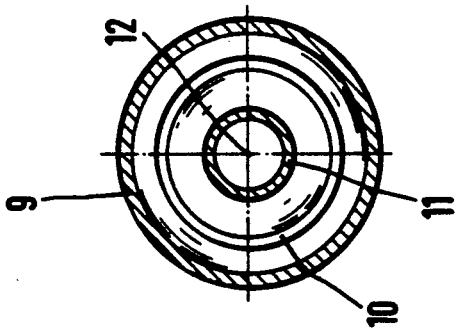
FIG. 2 shows a section through the cylindrical tube and the two rams along the line A—A of FIG. 1.
Figure 3:
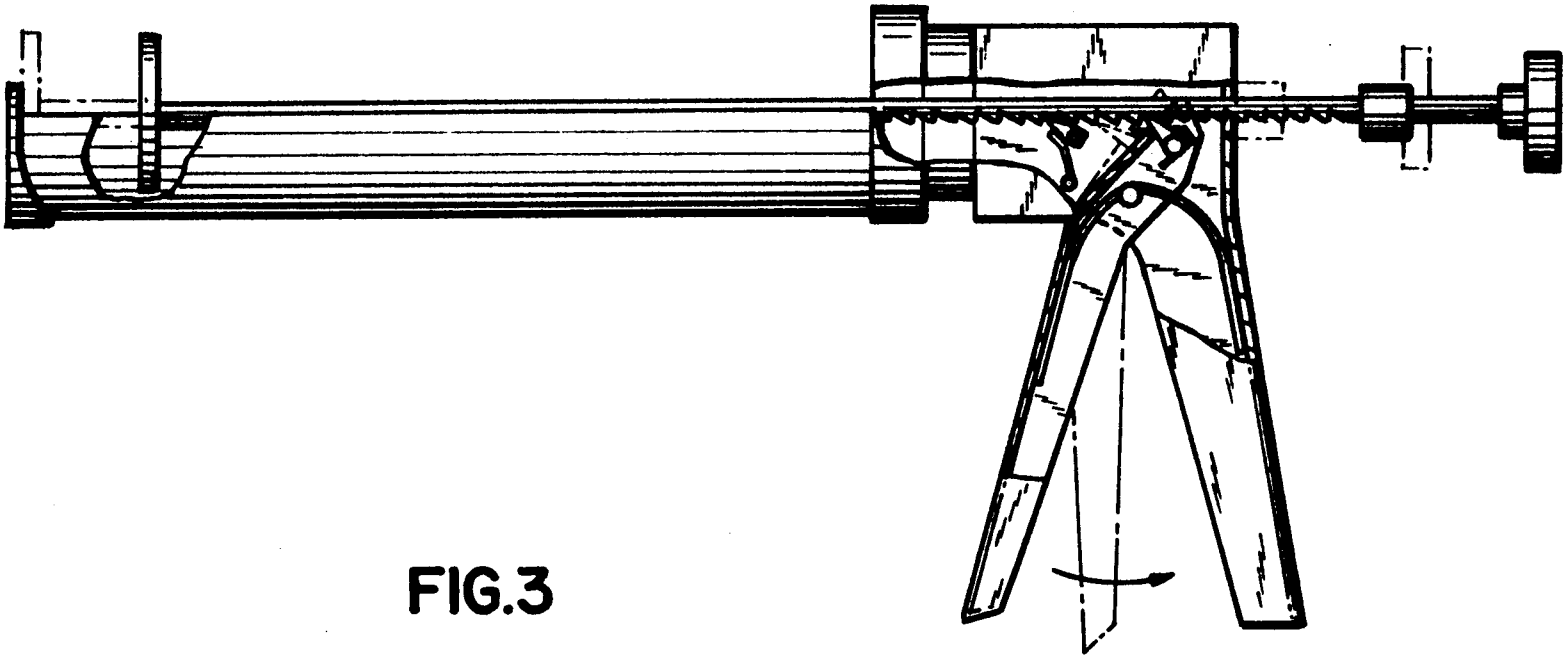
FIG. 3 is a side view of an ejection pistol of the type to which the present invention relates.

As shown in FIG. 2, the rams 10, 11 are dimensioned such that the inside circular ram 11 acts upon the circular piston 8 closing the inner cylindrical chamber 5, and the second ram 10 disposed coaxially therewith acts upon the ring-shaped piston 7 closing ring-shaped chamber 6.

The cylindrical tube may be made of plastic or metal, e.g., aluminum, whereby its outside diameter is adapted to the inside diameter of the trough-shaped half shell of the ejection pistol, and its inside diameter is adapted to the outside diameter of double-walled cartridge 1 to be ejected.

After the cylindrical tube is inserted into the ejection pistol and the double-walled cartridge 1 in such a way that pistons 7, 8 come to rest on the front ends of the rams 10, 11, operation of the pistol grip of the ejection pistol presses the ejection plate against the bottom 13 of the cylindrical tube 9 whereby a persisting expenditure of force pushes the cylindrical tube 9 over the outside wall of double-walled cartridge 1 (FIG. 1), and the rams 10, 11 act upon the pistons 7, 8 with a small time delay, conveying them toward the outlet port of the double-walled cartridge. The advance of the front edge of cylindrical tube 9 relative to the front ends of rams 10, 11 prevents an expansion of the outside wall of double-walled cartridge 1 since the latter is firmly surrounded by the cylindrical tube at the places of greatest pressure load. Every kind of uneven ejection, i.e. of unequal amounts, is avoided by constructing the chambers 5, 6 to have the same volume. If the chambers 5, 6 have different capacities for the pasty mass, the resulting constant mixture ratio is exactly adhered to.

There has thus been shown and described a novel ejection pistol for double-walled cartridges which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. An ejection pistol in combination with a double-walled cartridge, said ejection pistol comprising a hand operated pistol grip, a trough-shaped half shell, a piston rod mounted displaceably therein, and a substantially circular ejection plate disposed at the front end of the piston rod, said double-walled cartridge including two concentric material chambers, each having a discharge end, said chambers being slidable received in an open end of one side of a cylindrical tube, said cylindrical tube being close by a wall on a second end, said cartridge being disposed detachably and displaceably in the trough-shaped half shell and having affixed therein two spaced apart rams, wherein the rams are cylindrical in shape and are affixed to the tube wall coaxially with each other and coaxially with the longitudinal axis of the tube.

2. The improvement defined in claim 1, wherein the longitudinal extent of the rams is smaller than the longitudinal extent of the cylindrical tube.

* * * * *